United States Patent [19]

Horvath et al.

[11] Patent Number: 4,921,287

[45] Date of Patent: May 1, 1990

[54] SECURITY DOOR WINDOW LATCH

[76] Inventors: Edward Horvath, 1737 Libby Pl., Bronx, N.Y. 10461; George Spector, 233 Broadway #3815, New York, N.Y. 10007

[21] Appl. No.: 410,278

[22] Filed: Sep. 21, 1989

[51] Int. Cl.[5] ..... E05C 5/02

[52] U.S. Cl. ..... 292/106; 292/114; 292/67; 292/DIG. 30; 292/DIG. 47; 292/DIG. 60

[58] Field of Search ..... 292/57, 60, 218, 259, 292/100, 106, DIG. 30, DIG. 47, DIG. 60, 56, 58, 59, 61, 62, 114, 67, 63, 66

[56] References Cited

U.S. PATENT DOCUMENTS

| | | | |
|---|---|---|---|
| 223,624 | 1/1880 | DeWitt | 292/57 |
| 874,712 | 12/1907 | Tyden | 292/57 |
| 1,709,915 | 4/1929 | Morris | 292/57 |
| 3,737,183 | 6/1973 | Pastva, Jr. | 292/218 X |
| 4,286,810 | 9/1981 | Ehman | 292/DIG. 30 X |

FOREIGN PATENT DOCUMENTS

| | | | |
|---|---|---|---|
| 344249 | 3/1931 | United Kingdom | 292/57 |

*Primary Examiner*—Richard E. Moore

[57] ABSTRACT

A security latch assembly for a door and window in which the door security latch assembly configuration will prevent the door from an unauthorized opening when the assembly is in a secured locked position. The window security latch assembly configuration will prevent the upper and lower sashes of a window from an unauthorized opening when the assembly is in a second locked position.

4 Claims, 1 Drawing Sheet

SECURITY DOOR WINDOW LATCH

BACKGROUND OF THE INVENTION

The instant invention relates generally to fastening devices and more specifically it relates to a security latch assembly for a door and window.

Numerous fastening devices have been provided in prior art that are adapted to lock windows and doors in stationary positions to prevent unauthorized openings thereof. For example, U.S. Pat. No. 1,911,783 to Yudes; Pat. No. 4,486,980 to O'Bar; Pat. No. 4,553,353 to Simpson; Pat. No. 4,570,895 to Waldo et all and Pat. No. 4,791,756 to Simpson all are illustrative of such prior art. While these units may be suitable for the particular purpose to which they address, they would not be as suitable for the purposes of the present invention as heretofore described.

SUMMARY OF THE INVENTION

A primary object of the present invention is to provide a security latch assembly for a door and window that will overcome the shortcomings of the prior art devices.

Another object if to provide a security latch assembly for a door and window in which the door security latch assembly configuration will prevent the door from an unauthorized opening when the assembly is in a secured locked position.

An additional object is to provide a security latch assembly for a door and window in which the window security latch assembly configuration will prevent the upper and lower sashes of a window from an anauthorized opening when the assembly is in a secured locked position.

A further object is to provide a security latch assembly for a door and window that is simple and easy to use.

A still further object is to provide a security latch assembly for a door and window that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
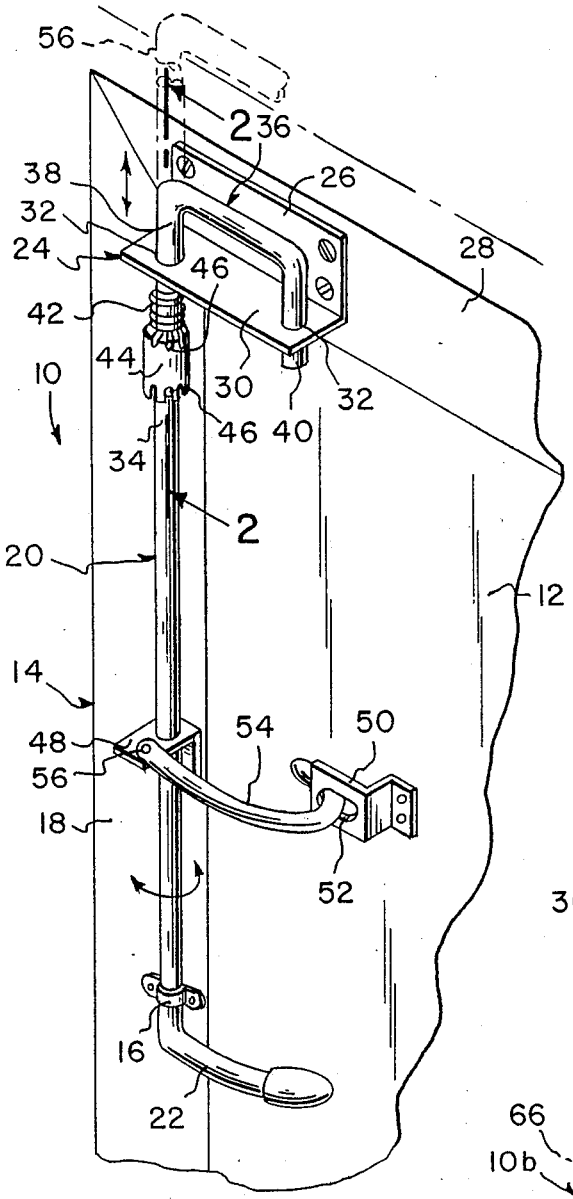
FIG. 1 is a perspective view of the invention showing a security latch assembly for a door.

Turning now descriptively to the drawings, in which similar reference characters denote similar elements throughout the several views, FIG. 1 illustrates a security latch assembly 10 for a door 12 hinged to a door frame 14. The assembly 10 consists of a lower bracket 15 mounted to jamb 18 of the door frame 14 opposite the hinged portion of the door 12. An elongated vertically disposed L-shaped latch rod 20 has a lower horizontal arm 22 which will bear against the door 12 in a locked position, as shown, and move away from the door 12 in an unlocked position. The latch rod 20 extends through the lower bracket 16 which supports the latch rod 20 for rotation about a vertical axis, while allowing the latch rod 20 to move upwardly and downwardly.

An upper L-shaped bracket 24 has a first leg 26 mounted to a lintel 28 of the door frame 14 and a second leg 30 has a pair of spaced apart apertures 32 therethrough, with one of the apertures 32 directly above top end 34 of the latch rod 20. A C-shaped locking rod 36 has ends 38 and 40 carried in both of the apertures 32 in the upper L-shaped bracket 24. A spring 42 is placed over the end 38 of the locking rod 36 that extends through the second leg 30 that is directly above the top end 34 of the latch rod 20.

Figure 2:
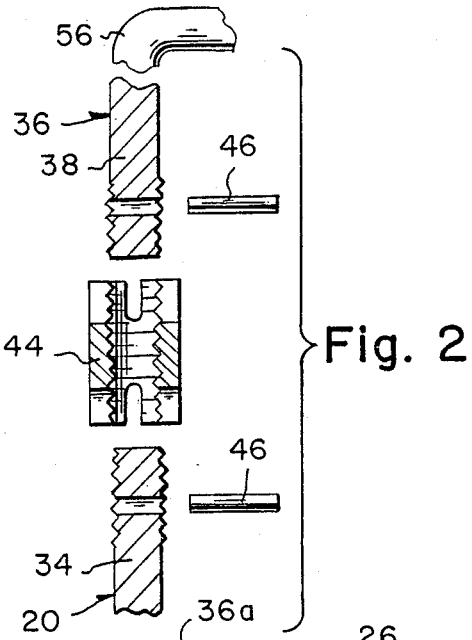
FIG. 2 is an exploded cross sectional view taken along line 2—2 in FIG. 1, showing details of the rod connector.

As best seen in FIG. 2, a connector 44 and a pair of pins 46 are utilized fo adjustably connecting the top end 34 of the latch rod 20 to the end 38 of the locking rod 36 with the spring 42 thereon. The spring 42 will bias the locking rod 36 downwardly allowing the free end 40 of the locking rod to enter the respective aperture 32 in the upper L-shaped bracket 24 in the locked position. A person can push up the horizontal arm 22 of the latch rod 20 to release the locking rod 26 which will go into the unlocked position to open the door 12.

A middle L-shaped bracket 48 is mounted to the jamb 18 between the lower bracket 16 and the adjustable connector 44. A Z-shaped bracket 50 having a slot 52 therein is mounted to the door 12. A hook member 54 is pivotally attached at 56 to the middle L-shaped bracket 48 so as to be engageable with the slot 52 in the Z-shaped bracket 50 to allow the door 12 to be partly opened and still be secured. An extension rod 56 shown in phantom can extend upwardly from end 38 of the locking rod 36 to another floor above so that the security assembly 10 can be operated therefrom.

Figure 3:
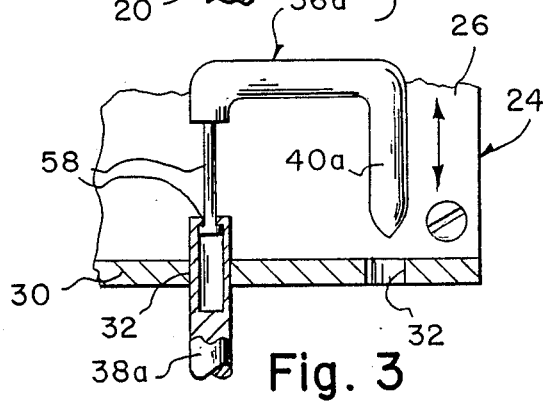
FIG. 3 is an elevational view with parts broken away and in section showing a modification in which the C-shaped locking rod can be manually removed and reset into the L-shaped bracket to operate the security latch assembly.

A modified C-shaped locking rod **36*a* is shown in FIG. 3 which is vertically telescopically adjustable at 58 so that the free end 40*a* can be manually removed and reset into the respective aperture 32 in the L-shaped bracket 24** to place the assembly into the unlocked position and the locked position.

Figure 4:
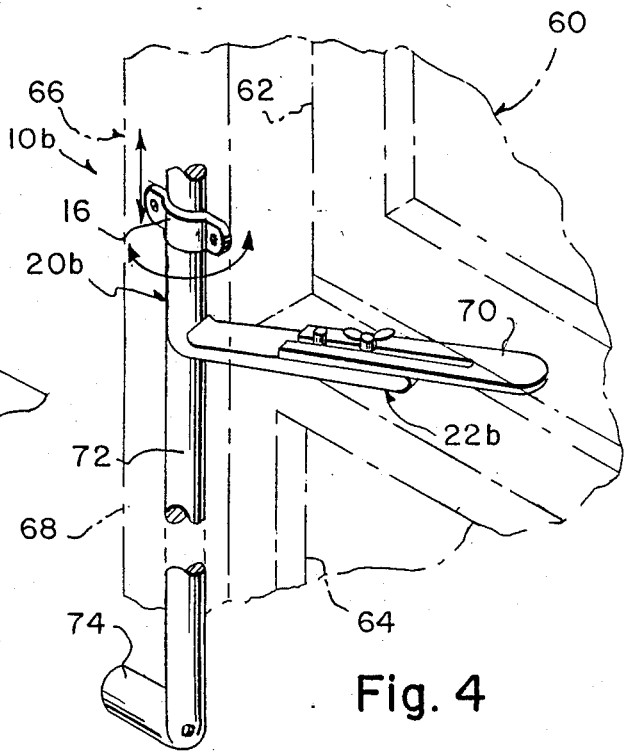
FIG. 4 is a perspective view of the lower portion of another form of the invention being a security latch assembly for a window showing the latch rod having an adjustable retaining arm used for locking upper and lower window sashes and an extension rod.

FIG. 4 shows the lower portion of a security latch assembly **10*b* for a window 60 having an upper sash 62 and a lower sash 64 within a window frame 66, the asembly 10*b* contains a lower bracket 16 mounted to jamb 68 of the window frame 66. An elongated vertically disposed L-shaped latch rod 20*b* has a lower horizontal adjustable retaining arm 22*b* which will fit between the upper sash 62 and lower sash 64 in a locked position, as she own, and move away from between the upper sash 62 and lower sash 64 in an unlocked position. The latch rod 20*b* extends through the lower bracket 16 for supporting the latch rod for rotation about a vertical axis while allowing the latch rod 20*b* to move upwardly and downwardly. The upper portion of the security latch assembly 10*b* is identical to the one shown in FIG. 1 except that the first leg 26 is mounted to a lintel (not shown) of the window frame 66. A person can move a portion 70 of the retaining arm 22*b* from between the upper sash 62 and lower sash 64 and push up the retaining arm 22*b* of the latch rod 20*b* to release the locking rod 36 which will go into the unlocked position so that the window 60 will open. An extension rod 72 can extend downwardly from the latch rod 20*b* and have a knob 74 at its distal end so that a person can operate the assembly 10*b* down below the window 60**.

Figure 5:
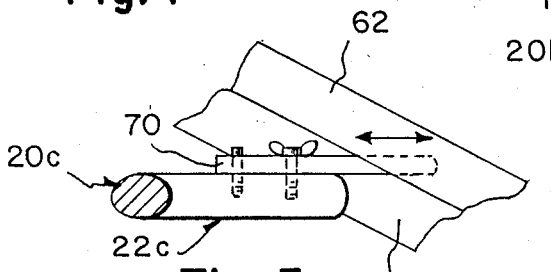
FIG. 5 is a top view of the further modification of FIG. 4, showing the adjustable retaining arms having one segment mounted laterally of the other.

FIG. 5 shows a modified retaining arm **22*c* extending from the latch rod 20*c* in which the movable portion 70 is mounted laterally thereto and functions in the same manner as the one in FIG. 4**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A security latch assembly for a door hinged to a door frame, said assembly comprising:

(a) a lower bracket mounted to jamb of the door frame opposite the hinged portion of the door;

(b) an elongated vertically disposed L-shaped latch rod having a lower horizontal arm which will bear against the door in a locked position and move away from the door in an unlocked position, said latch rod extending through said lower bracket which supports said latch rod for rotation about a vertical axis while allowing said latch rod to move upwardly and downwardly;

(c) an upper L-shaped bracket having a first leg mounted to a lintel of the door frame and a second leg having a pair of spaced apart apertures therethrough with one of said apertures directly above top end of said latch rod;

(d) a C-shaped locking rod having ends carried in both of said apertures in said upper L-shaped bracket;

(e) a spring placed over the end of said locking rod extending through said second leg that is directly above the top end of said latch rod; and (f) means for adjustably connecting the top end of said latch rod to the end of said locking rod with said spring thereon which will bias said locking rod downwardly allowing the free end of said locking rod to enter said respective aperture in said upper L-shaped bracket in the locked position, whereby a person can push up said horizontal arm of said latch rod to release said locking rod which will go into the unlocked position to open the door.

2. A security latch assembly as recited in claim 1, further comprising:

(a) a middle L-shaped bracket mounted to the jamb between said lower bracket and said adjustably connecting means;

(b) a Z-shaped bracket having a slot therein and mounted to the door; and (c) a hook member pivotally attached to said middle L-shaped bracket to be engageable with the slot in said Z-shaped bracket to allow the door to be partly opened and still be secured.

3. A security latch assembly as recited in claim 2, wherein said C-shaped locking rod is vertically telescopically adjustable so that the free end can be manually removed and reset into said respective aperture in said C-shaped bracket to place said assembly into the unlocked position and the locked position.

4. A security latch assembly for a window having an upper sash and a lower sash within a window frame, said assembly comprising:

(a) a lower bracket mounted to jamb of the window frame;

(b) an elongated vertically disposed L-shaped latch rod having a lower horizontal adjustable retaining arm which will fit between the upper sash and lower sash in a locked position and move away from between the upper sash and lower sash in an unlocked position, said latch rod extends through said lower bracket for supporting said latch rod for rotation about a vertical axis while allowing said latch rod to move upwardly and downwardly;

(c) an upper L-shaped bracket having a first leg mounted to a lintel of the window frame and a second leg having a pair of spaced apart apertures therethrough with one of said apertures directly above top end of said latch rod;

(d) a C-shaped locking rod having ends carried in both of said apertures in said L-shaped bracket;

(e) a spring mounted on the one end of said locking rod extending through said second leg that is directly above the top end of said latch rod; and (f) means for adjustably connecting the top end of said latch rod to the one end of said locking rod having said spring thereon which will bias said locking rod downwardly allowing the free end of said locking rod to enter said respective aperture in said upper L-shaped bracket in the locked position, whereby a person can move a portion of said retaining arm from between the upper sash and lower sash and push up said retaining arm of said latch rod to release said locking rod which will go into the unlocked position so that the window will open.

* * * * *